United States Patent [19]

Smialkowski

[11] Patent Number: 4,648,732

[45] Date of Patent: Mar. 10, 1987

[54] APPLICATOR FOR DISPENSING FLUIDS

[76] Inventor: Zozislaus Smialkowski, 303 No. Union Ave., Cranford, N.J. 07016

[21] Appl. No.: 758,549

[22] Filed: Jul. 24, 1985

Related U.S. Application Data

[63] Continuation-in-part of Ser. No. 650,447, Sep. 14, 1984, abandoned.

[51] Int. Cl.[4] ..... B05C 17/02; B05C 1/10

[52] U.S. Cl. ..... 401/196; 401/197; 401/207; 401/208

[58] Field of Search ..... 401/196, 197, 183, 208, 401/203, 207; 15/104 A, 230.11

[56] References Cited

U.S. PATENT DOCUMENTS

| | | | |
|---|---|---|---|
| 895,472 | 8/1908 | Knickerbocker | 401/203 |
| 2,225,101 | 12/1940 | Conk et al. | 401/203 |
| 2,860,359 | 11/1958 | James | 401/183 |
| 2,895,486 | 7/1959 | Sayer | 401/207 X |
| 3,421,170 | 1/1969 | Thomas, Jr. | 15/104 A |
| 3,431,616 | 3/1969 | Lewis | 401/197 X |
| 3,609,051 | 9/1971 | Braun | 401/197 |
| 4,361,923 | 12/1982 | McKay | 15/230.11 X |

FOREIGN PATENT DOCUMENTS

| | | | |
|---|---|---|---|
| 2046596 | 11/1980 | United Kingdom | 401/208 |

*Primary Examiner*—Steven A. Bratlie

*Attorney, Agent, or Firm*—Bucknam and Archer

[57] ABSTRACT

An applicator for dispensing small amounts of fluid comprises a first inner cylindrical body provided with a top portion and a bottom portion and at least one side opening. This body is connected with a fluid dispensing device at one end. A second outer cylindrical body is in tight contact with the inner body at one point in proximity of the top portion and at another point in proximity of the bottom portion of the inner body. The outer body comprises a plurality of ribs, orifices between the ribs, two solid ledges holding the ribs at the upper and the lower end, an upper and a lower overhang, and an absorbing element held between the overhangs.

8 Claims, 10 Drawing Figures

APPLICATOR FOR DISPENSING FLUIDS

This application is a Continuation in part of U.S. Ser. No. 650,447 filed Sept. 14, 1984 now abandoned.

The present invention relates to a liquid applicator and more particularly to an applicator of the type which may be applied with a roller.

Paint rollers commonly used in the household require a separate pan in which the user must dip the roller. The obvious drawbacks of these types of applicators are the time involved in dipping the roller into the pan and the possibility of dripping.

One type of liquid applicator is described in U.S. Pat. No. 3,196,479. The device of this patent permits to be connected to a source of liquid and also permits the liquid to be applied by means of a roller. The device according to this reference, however, may be suitable in the case of paints, but is expensive to manufacture and is not readily applicable in the case in which small amounts of liquid must be applied, for instance in the case of hair tints and hair dyes.

An object of the present invention is to provide a liquid applicator of simple construction which may be applied by means of a roller with a sponge or similar absorbing fabric and which may be connected by conventional means to a container for dispensing the liquid.

Another object of the present invention is to provide a liquid applicator, particularly suitable for applying small amounts of liquid.

Still another object is to provide a liquid applicator which may be integrally molded with the conventional cap of a bottle.

These objects are achieved by a liquid applicator which comprises an inner cylindrical body, preferably tapered at one end and provided with at least one side opening. The applicator also comprises a second cylindrical body or overcap, also tapered at one end, which is snapped on the exterior of the first cylindrical body and which consists of a plurality of cut-out portions and intermediate ribs and a sponge or other absorbing pile material placed on the exterior of the second cylindrical body. The first cylindrical body is connected by conventional means, for instance conventional threading, to a liquid dispensing device, such as a bottle or may be molded integrally with the cap of the bottle. The outer body has an upper and a lower overhang portions which establish a seat for the sponge so that it will not be displaced during operation.

An essential feature of the present invention is that there must be two points of contact between the first and the second cylindrical bodies in order to avoid dripping and to make sure that the outer body snaps properly over the inner body.

The invention will further be illustrated by reference to the accompanying drawings of which:

By reference to the drawings, FIGS. 1–4, numeral 5 designates the portion of the inner body which is intended to engage with a liquid dispensing device, for instance, a bottle, by threading. Numeral 6 designates at least one orifice in the cylindrical tapered portion so that the fluid from the dispensing bottle reaches the chamber in the inner body and then flows out. Numeral 7 designates a raised rib of spiral shape, which permits the fluid to spread evenly but this feature is not essential. Numeral 8 is a ridge which minimizes wedging during operation. Numerals 11 and 12 designate respectively the bottom and top points of contact between the outer and inner body. Numeral 9 is a protruding closed lip which serves as a cap to close the device and which is provided with an extension 10, serving as a bearing, the latter providing for minimum dripping.

Figure 1:
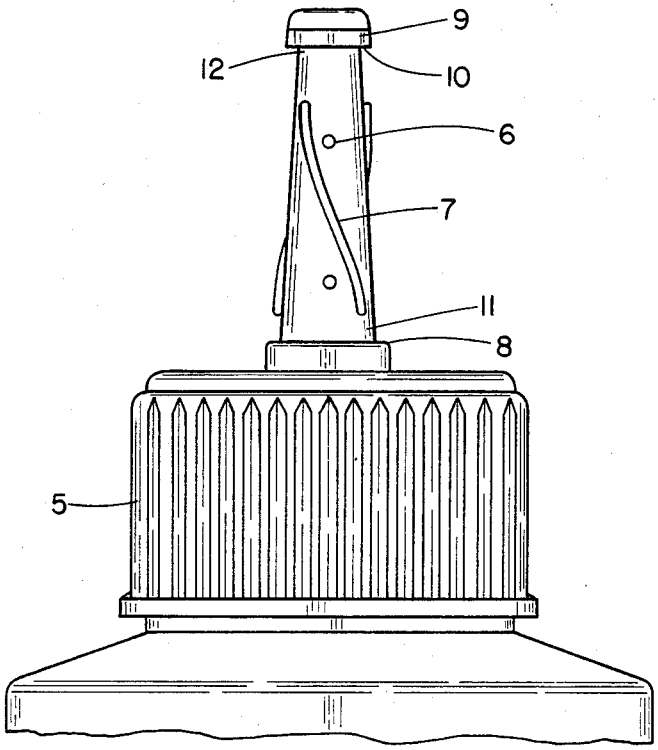
FIG. 1 illustrates the inner cylindrical body.
Figure 2:
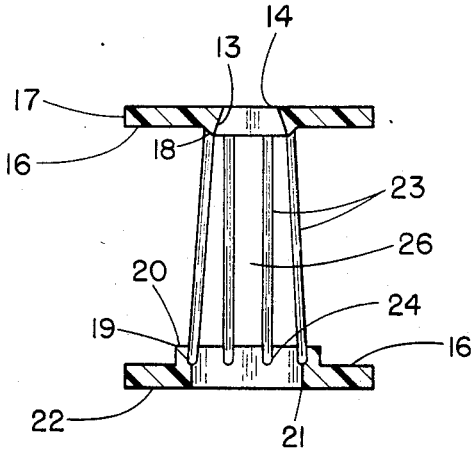
FIG. 2 illustrates the outer cylindrical body or overcap.

By reference to FIG. 2, which designates the outer cylindrical body, numeral 23 designates the ribs and numeral 26 designates the hollow portions between the ribs. Numeral 13 is the inner portion of the outer cylindrical body which snaps in the interior of the cap 9 and which is provided with a ledge 14 of smaller diameter which prevents the outer cylinder from coming out of contact with the inner cylinder. Numeral 16 is an inner shoulder on which the sponge is intended to rest and numeral 17 designates the outer diameter of the shoulder 16. Numerals 18 and 19 are the solid upper and lower portion respectively which hold the ribs. Numeral 20 designates the bottom ledge. Numeral 22 is the bottom shoulder. Numeral 21 designates the point of contact required for proper bearing action.

It should be noted that portions 11 and 21 are of essentially equal diameter to provide good spinning. Portions 12 and 13 make contact and provide snap fit at 9. Portion 13 must have a diameter slightly larger than portion 12 but smaller than 9.

Figure 3:
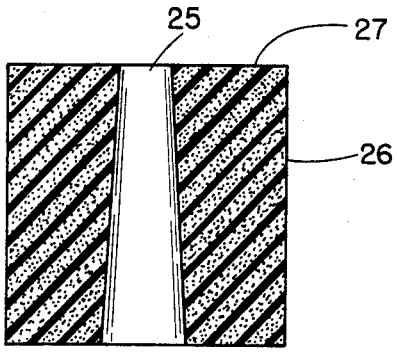
FIG. 3 illustrates the sponge or a similar absorbing material in cross section.
Figure 4:
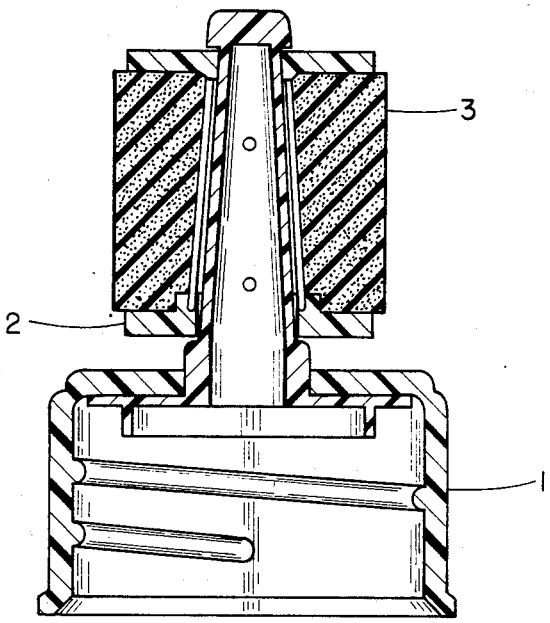
FIG. 4 is a cross-section of FIGS. 1, 2 and 3 when assembled.

By reference to FIG. 3, numeral 25 is an opening in the sponge which is desirable in order to assemble the sponge on the outer cylinder. Numeral 26 is the outer diameter of the sponge which must be slightly larger than the diameter of the overhang of the outer cylinder designated by numeral 17. Numeral 27 designates the length of the sponge which should correspond to the distance between the two surfaces designated by numeral 16 in FIG. 2.

When the device according to the present invention is operated, the liquid is supplied from the container, fills the chamber in the inner cylinder, flows out from the openings 6 and reaches the cut-out portions between the ribs 23 of the outer cylinder. As the roller is rotated, the liquid is evenly applied. The contact points between the inner and the outer cylinder ensure a free, smooth, bearing-like roller action. The solid overhead lip in the overcap prevents the outer cylinder from coming off. The applicator according to the present invention is particularly suitable for dispensing small amounts of liquid. The portion 5 of the inner body may be readily adjusted to fit the conventional bottles or similar containers in which the tints or dyes are sold.

Figure 5:
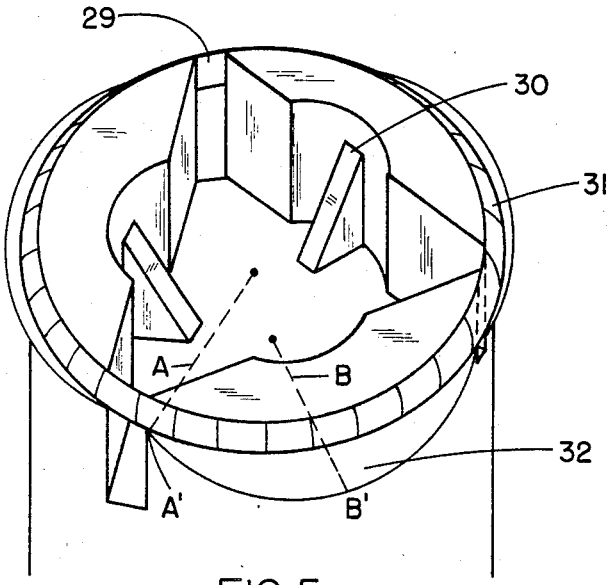
FIG. 5 illustrates the inner body according to another embodiment of the invention.

In the embodiment of FIG. 5, the inner body is preferably integral with the screw cap of the bottle. It also comprises three slots 29 at the top which allow the inner body to flex during the molding step in the process of manufacture. Numeral 30 designates three gussets in the interior in the top part. (One gusset is not shown). Numeral 31 is a solid ring around the top of the inner body which contributes to hold the outer body on the inner cylinder. Three radial protrusions 32 on the top of the inner body, have a radius B smaller than the radius A of ring 31.

Figure 6:
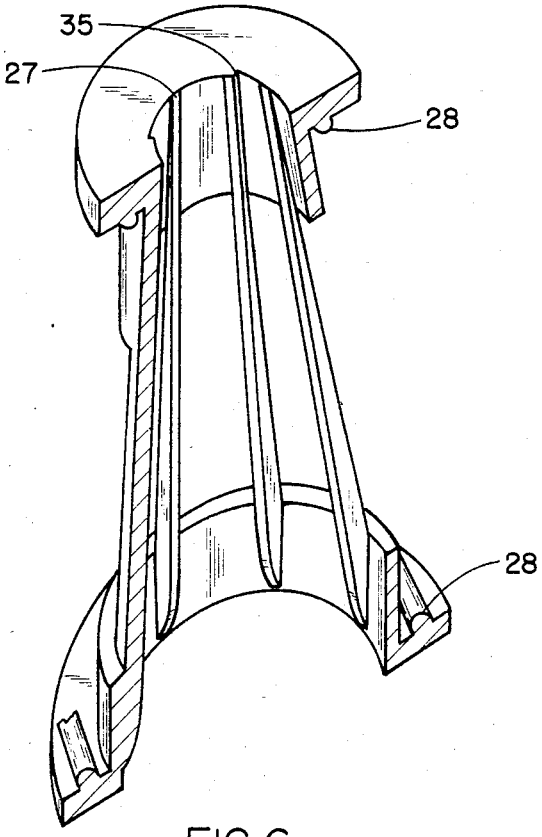
FIG. 6 illustrates the outer body to be used with the inner body of FIG. 5.
Figure 7:
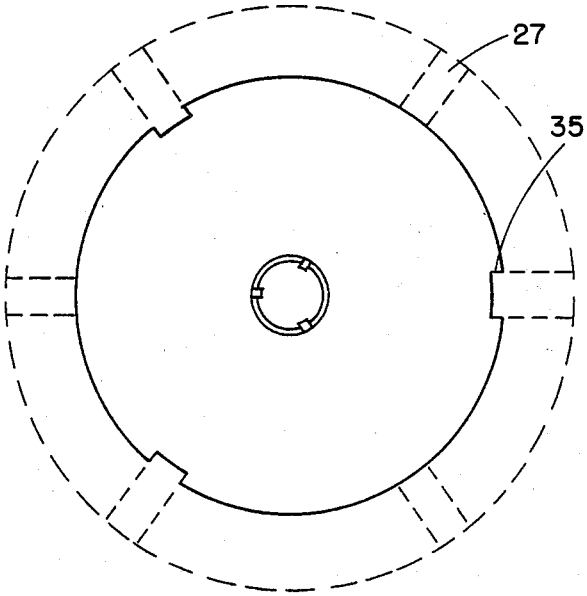
FIG. 7 is a cross sectional view of the outer body of FIG. 6 at the top portion thereof.
Figure 8:
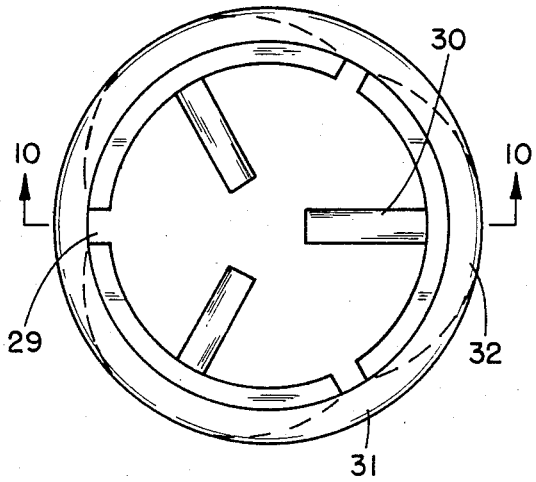
FIG. 8 is a cross sectional view of the inner body of FIG. 5.
Figure 9:
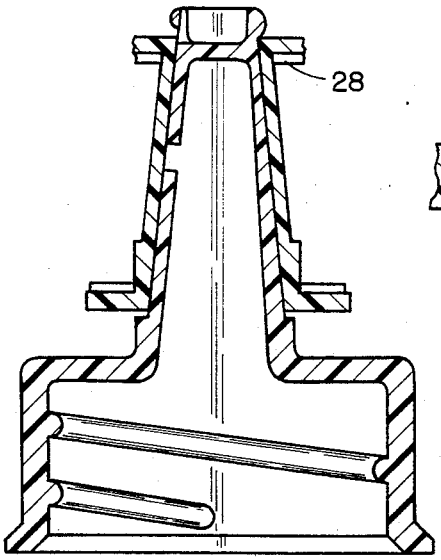
FIG. 9 is an elevational view of cross section of the outer body when it is snap fitted with the inner body.
Figure 10:
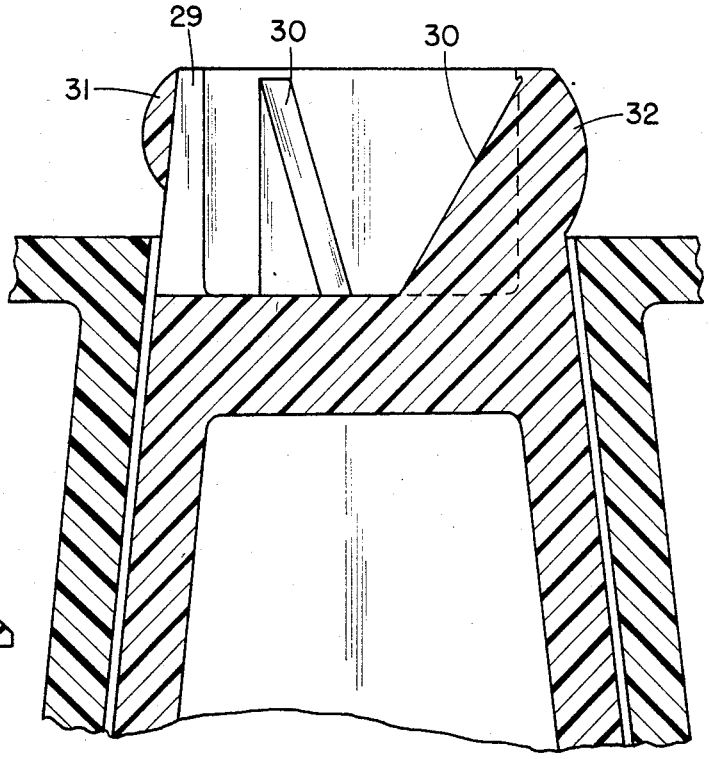
FIG. 10 is a sectional view of the inner body along section A—A of FIG. 8.

The outer body being used together with the inner body of FIG. 5 is shown in FIG. 6. It is provided with an even number of ribs 27, 4, 6, or 8, preferably 6 and every other rib 35 is slightly deeper than the adjacent ribs 27. This permits the outer cylinder to revolve only on points 35, thus resulting in a camming effect. This provides for the outer cylinder to come in contact with the inner cylinder at the top.

Numeral 28 designates two ribs on the lower ledge and two protrusions on the upper ledge. These ribs 28 permit the sponge to drive over them and contribute to prevent the sponge from slipping around the cylinder. As shown in FIG. 5, the radius A is longer than the radius B of the circle formed by the protrusion 32. The result is that when the outer body revolves, the three deeper ribs 35 come in contact alternately with the point of longer radius and with the point of shorter radius. Thus, the solution in the sponge is agitated during the travel from point B′ to point A′.

The size of the different components of the applicator of the present invention depends on the bottle with which the applicator is used. In general, when the inner body is 2.5–3 cm long and a width at the bottom of 1 cm–1.5 cm, the width at the top is ⅜–0.5 cm. The three protrusions 32 in FIG. 5 are 0.1–0.2 cm. The gussets 30 in the interior of the inner body are 0.1 cm–0.2 cm. With respect to the outer body, the ribs 35 are deeper than the ribs 27 adjacent to them by about 0.001–0.003 cm. The ribs 28 are about 0.2 cm–0.4 cm. When the outer body of FIG. 6 is assembled with the inner body of FIG. 5, the inner body extends beyond the outer body by about 0.25 cm–0.4 cm.

The applicator according to the present invention is particularly suitable for dispensing small amounts of liquid through its openings. As the outer cylinder revolves, the ribs control the amount of liquid and let the sponge be impregnated with the liquid. The ribs 35 also give a three-point contact and an even roller action on the inner cylinder.

What is claimed is:

1. An applicator for dispensing small amounts of fluid which comprises a first inner cylindrical body provided with a top portion and a bottom portion (8) and at least one side opening (6), means on said body for connecting with a fluid dispensing device at one end thereof, a second outer cylindrical body in tight contact with said first cylindrical body at one point (12) in proximity of said top portion and at another point (21) in proximity of the bottom portion of said first cylindrical body, said second cylindrical body comprising a plurality of ribs (23), orifices between the ribs (26), two solid ledges (18, 19) holding the ribs at the upper and lower end thereof, an upper and a lower overhang member (16, 17), an absorbing element held between said overhang members, a closure member on said first cylindrical body at the top portion opposite to said means for connecting with the fluid dispensing device, said closure member comprising a cap (9), said second cylindrical member having a ledge (14) at the top thereof, said cap having an inner diameter, said ledge having a diameter smaller than the diameter of said cap, whereby said ledge is adapted to snap in the interior of said cap, said first cylindrical body being tapered at the top thereof.

2. The applicator according to claim 1, wherein said closure member is a solid cap integral with said first cylindrical body.

3. The applicator according to claim 1, wherein said absorbing member is a sponge positioned between said overhang members.

4. The applicator according to claim 1, wherein said first cylindrical body is provided with a rib (7) of spiral shape longitudinally located.

5. An applicator for dispensing small amounts of fluid which comprises a first inner cylindrical body provided with a top portion and a bottom portion (8), and at least one side opening (6), a second outer cylindrical body in tight contact with said first cylindrical body at one point (12) in proximity of said top portion and at another point (21), in proximity of the bottom portion of said first cylindrical body, said second cylindrical body comprising a plurality of ribs (23), orifices between the ribs (26), two solid ledges (18, 19) holding the ribs at the upper and the lower end thereof, an upper and a lower overhang members (16, 17), an absorbing element held between said overhang members, wherein the fluid dispensing device is a bottle with a neck and the applicator is integrally molded with said neck, said outer body has an even number of ribs, three alternate ribs are deeper than two adjacent ribs, said inner cylindrical body has a ring and three protrusions at the top thereof, said ring and said protrusions each having a radius, the radius of said protrusions being smaller than the radius of said ring, and said outer cylindrical body snap-fits under said protrusions and said ring.

6. The applicator according to claim 5, wherein said outer body has six ribs.

7. The applicator according to claim 5, wherein the inner body has at the top, in the interior thereof three gussets of size smaller than the depth of said protrusions.

8. The applicator according to claim 5, wherein the outer body has two first ribs on the top of the bottom ledge and two second ribs on the upper ledge, which are parallel to the two first ribs.

* * * * *